United States Patent [19]

LeBlond

[11] 4,434,691

[45] Mar. 6, 1984

[54] METHOD AND APPARATUS FOR SEALING CUT SHEET MATERIAL

[75] Inventor: Claude W. LeBlond, Enfield, Conn.

[73] Assignee: Gerber Garment Technology, Inc., South Windsor, Conn.

[21] Appl. No.: 367,429

[22] Filed: Apr. 12, 1982

[51] Int. Cl.[3] ..... B26D 3/00; B26D 7/02

[52] U.S. Cl. ..... 83/56; 83/152; 83/422; 83/451; 83/925 CC

[58] Field of Search ..... 83/13, 39, 56, 71, 152, 83/216, 217, 263, 747, 734, 925 CC, 451, 434

[56] References Cited

U.S. PATENT DOCUMENTS

| | | | |
|---|---|---|---|
| 3,682,750 | 8/1972 | Gerber | 83/925 CC |
| 3,742,802 | 7/1973 | Maerz | 83/451 |
| 3,777,604 | 12/1973 | Gerber | 83/925 CC |
| 3,797,341 | 3/1974 | Bystron | 83/925 CC |
| 4,322,993 | 4/1982 | Stumpf | 83/925 CC |
| 4,328,726 | 5/1982 | Pearl | 83/217 |
| 4,345,496 | 8/1982 | Pearl | 83/925 CC |

*Primary Examiner*—E. R. Kazenske
*Assistant Examiner*—Hien H. Phan
*Attorney, Agent, or Firm*—McCormick, Paulding & Huber

[57] ABSTRACT

An automatically controlled cutting machine includes a conveyor table having an endless conveyor belt for moving segments of limp sheet material onto the table for cutting. A cutting carriage and blade are mounted for controlled movement over the support surface of the table to cut pattern pieces from the limp sheet material positioned on the surface. A vacuum system holds the material in a compressed state on the support surface during cutting, and an air-impermeable overlay is spread on top of the cut material to seal the material and prevent leakage into the vacuum system. The overlay is an elongated strip with the opposite longitudinal ends wound into rolls. One roll is mounted on a self-retracting roller and connected with the cutting carriage to spread the overlay onto the cut sheet material as the carriage moves back and forth. The other roll is mounted on a motor driven roller at one end of the conveyor belt with the interconnecting portion between the rolls overlying the support surface of the table and any layup thereon. As the cut layup is moved off of the cutting table, the overlay material is retrieved by the motor driven roller. At periodic intervals, portions of the overlay strip accumulated on the motor driven roller are shifted back to the self-retracting roller mounted on the cutting carriage.

16 Claims, 8 Drawing Figures

METHOD AND APPARATUS FOR SEALING CUT SHEET METAL

BACKGROUND OF THE INVENTION

The present invention resides in a method and apparatus for working on limp sheet material, particularly layups of limp sheet material which are cut by an automatically controlled cutting blade.

Prior art cutting systems which include automatically controlled cutting machines for limp sheet material are shown in U.S. Pat. No. 3,495,492 and U.S. Pat. Application No. 207,873, filed Nov. 18, 1980, now U.S. Pat. No. 4,328,726 having the same assignee as the present invention. Each of these prior art machines employs a vacuum holddown system in the cutting table on which the limp sheet material is positioned for cutting. When vacuum is applied to the material, the material is compressed and held fixedly in position on the table to perform the cutting with greater ease and accuracy.

The limp sheet materials cut on automatically controlled machines include woven and non-woven fabrics, leather, paper, synthetics such as vinyl, plastic, foils, composites and other materials, and frequently the materials are cut in patterns that are arranged in a closely nested array called a "marker" to minimize the amount of material wasted. Generally, a marker of pattern pieces used, for example, to manufacture garments, may have overall dimensions of 6 feet (2 meters) in width and 24 feet (8 meters) or more in length. The pattern pieces are cut in a single operation by laying the sheet material in a multi-ply stack called a layup, and cutting the pattern pieces from the layup. Conveyorized cutting tables having a length less than the overall length of a single layup are commonly used and cut the layup in two or more sequential segments. A first segment is positioned on the work surface of the conveyor table for cutting in a first operation, and then the second segment or "bite" is moved onto the cutting table for cutting while the first segment is removed.

Since substantial energy is required to evacuate the layup of sheet material, particularly after the material has been partially cut by the blade, the prior art cutting machines have employed a zoned cutting table. In a zoned table, vacuum is applied only to a limited portion of the layup where the cutting blade is operating. The cutting carriage supporting the blade controls the application of vacuum to the appropriate portion of the table through a system of valves and chambers within the bed of the table.

While the zoned cutting tables are intended to reduce the loss of vacuum within a layup and to minimize the amount of energy required to hold the sheet material firmly in position during cutting, their construction is complex and expensive, and substantial leakage occurs through the cuts in the material and also through the table bed which is generally made from a porous material such as bristles to prevent damage to the reciprocating cutting blade. Attempts to reduce leakage in addition to zoning the table have included the installation of air impermeable barriers in the otherwise air-permeable bed to stop horizontal flow of air between the active and inactive zones, the placement of an air-impermeable overlay on the layup of limp sheet material and the exposed portions of the bed and the mounting of endless belts of air-impermeable material on top of the layup to cover the holes or kerfs produced in the material by the cutting operation.

Another approach designed to minimize leakage and loss of vacuum through cut material is shown in U.S. Pat. No. 3,742,802. In this patent, two air-impermeable overlays are wound in opposite directions about two spaced and parallel rollers respectively, and the rollers are mounted on the cutting carriage with the cutting blade. The free ends of the overlays are secured to opposite ends of the cutting table so that the overlay material is wound on and off of the rollers in the manner of a roller shade as the cutting carriage moves back and forth over the table while the blade is cutting. In this prior art, the only portion of the layup exposed during cutting is that portion of the material lying in the gap provided between the two spaced rollers to permit the cutting blade to reach the material. In contrast to the sacrificial overlays that are cut by the blade, the rolled overlays in U.S. Pat. No. 3,742,802 are not cut and may be used again and again in many cutting operations.

It is an object of the present invention to provide an automatically controlled cutting machine that has an air-impermeable overlay spread on and retrieved from cut sheet material that is held firmly in position by vacuum during cutting.

SUMMARY OF THE INVENTION

The present invention resides in a method and apparatus for cutting limp sheet material while the material is held firmly in position on a cutting table by vacuum.

The apparatus which performs the method includes a cutting table, such as a conveyor table having an endless conveyor belt for moving a layup of limp sheet material between one end of the table and the other. The belt defines a work support surface for holding the sheet material as it is moved on and off of the table and also while the material is being cut. The table has a vacuum system for holding the sheet material fixedly on the support surface in a compressed condition for cutting. Preferably the conveyor has an air-permeable conveyor belt, and the vacuum system communicates with the sheet material through the belt.

An air-impermeable overlay in the form of an elongated strip has opposite ends of the strip wound respectively onto first and second rollers. The first roller is rotatably mounted to the tool carriage for movement with the carriage and a cutting tool relative to the cutting table and a layup of sheet material thereon during cutting. The second roller is rotatably mounted to the cutting table in parallel and generally aligned relationship with the first roller.

During a cutting operation, a portion of the strip of overlay material is spread on the layup from the first roller as the cutting tool progressively advances along the layup from one end of the cutting table toward the other. Retracting means are connected with the first roller for winding the strip of air-impermeable overlay material onto the first roller as the tool carriage moves back over the already covered sheet material.

Another retracting means is connected with the second roller for retrieving that portion of the strip which has been spread on the cut sheet material as the material is removed from the table after cutting. When the cut material is removed, the overlay material retrieved on the second roller is transferred back to the first roller.

Accordingly, the air-impermeable overlay is spread on the cut sheet material to maintain a vacuum in the material during cutting, and the overlay is retrieved from the material as it is removed from the table for re-use in subsequent cutting operations.

DESCRIPTION OF THE PREFERRED EMBODIMENTS

Figures 1, 2:
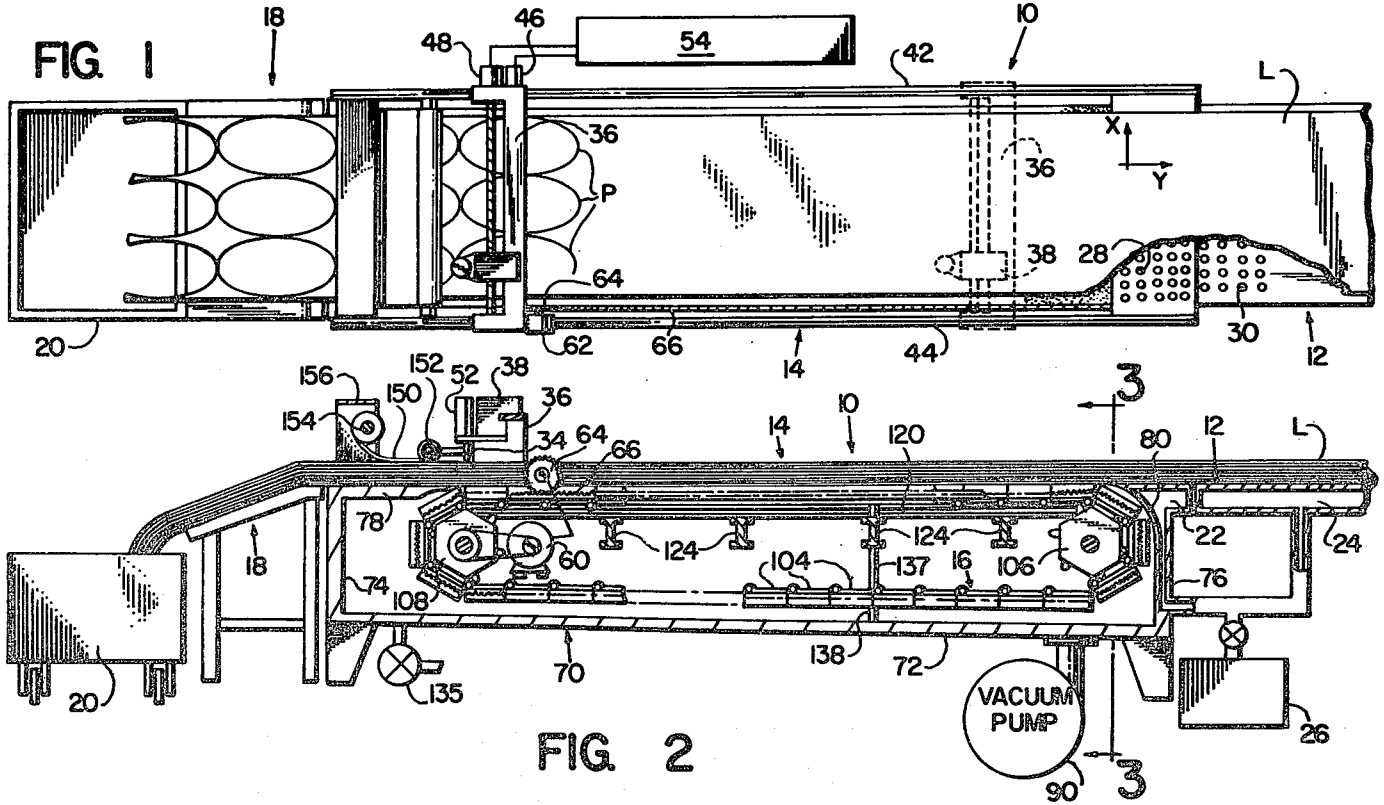
FIG. 1 is a plan view of an automatically controlled cutting machine embodying the present invention.
FIG. 2 is a side elevation view of the cutting machine in FIG. 1.

FIGS. 1 and 2 illustrate an automatically controlled cutting machine, generally designated 10, which is constructed in accordance with the present invention. The machine 10 is used to cut pattern pieces P from a multiply layup L of limp sheet material. The sheet material typically is a woven or non-woven fabric but may include a number of other materials such as synthetics, plastics, paper, leather and other such materials. The pattern pieces can have a variety of sizes and shapes and are layed out in an array or "marker" for most economical use of the sheet material. Typically, the pattern pieces may be used to manufacture garments or upholstery, but the number and type of end products are unlimited.

The layup L of limp sheet material may be formed by simultaneously drawing a plurality of sheets from a corresponding plurality of bolts of cloth. In the present case, however, the layups are formed by a cloth spreader (not shown) on a spreading table 12 adjacent one end of the cutting machine 10.

The cutting machine 10 is comprised by a conveyor table 14 which supports one segment of the layup L during a cutting operation. The table includes a motor driven conveyor belt 16 which moves the layup from the spreading table onto the conveyor table for cutting and off of the table after cutting. The conveyor belt 16 extends from the loading end of the table abutting the spreading table 12 to the opposite, unloading or discharging end abutting a sloped discharge table 18. The cut pattern pieces P in the layup L are tied or bound in bundles on the discharge table and are then removed to a sewing or assembly room. The remaining cloth is dumped in the cart 20.

To facilitate movement of the layup L from the spreading table 12 onto the conveyor table 14, an air flotation apparatus is provided in the abutting aprons of the conveyor and spreading tables. An air pump 26 supplies a large volume of low pressure air to the chambers 22, 24 in the respective tables, and the supporting surfaces of the table aprons are provided with apertures 28, 30 as shown in FIG. 1 to generate an air bearing between the supporting surfaces and the layup. The air bearing supports the layup with minimal friction when the motor driven conveyor belt 16 moves a segment of the layup onto the conveyor table.

A cutting tool in the form a reciprocating cutting blade 34 is mounted over the conveyor table 14 by means of two cutting tool carriages, an X-carriage 36 and a Y-carriage 38. The X-carriage is mounted on guide ways 42, 44 on opposite lateral sides of the conveyor table and moves back and forth with the cutting blade 34 and the Y-carriage 38 under the driving forces of an X-drive motor 46. The drive motor 46 rotates pinions 47 (FIG. 3) which engage stationary racks 49 under the guide ways to precisely control the movement of the carriage in the X-coordinate direction.

The Y-carriage 38 is mounted on the X-carriage 36 and moves relative to the conveyor table 14 in the illustrated Y-coordinate direction under the control of a Y-drive motor 48 and a lead screw 50 engaging the Y-carriage. The cutting blade 34 is suspended from the Y-carriage 38 and a rotational drive motor 52 also mounted on the Y-carriage orients the cutting blade in a direction generally tangent to the line of cut through the layup of sheet material. All of the drive motors 46, 48 and 52 and a reciprocation drive motor (not shown) connected with the blade are operated by a control computer 54 in response to a cutting program which defines the contours and positioning of the pattern pieces P as cut from the layup L.

When all of the pattern pieces P have been cut in the one segment of the layup on the support surface of the conveyor table 14, the cutting operation is momentarily interrupted and a conveyor drive motor 60 is energized to drive the conveyor and move a new, uncut segment onto the table from the spreading table 12. The cut portion of the layup, at the same time, is moved off the discharged end of the conveyor table to the table 18 where the cut pattern pieces are bundled and removed.

In one form of the cutting machine 10, a cutting operation is initiated near the discharge end of the conveyor table 14 and the cutting blade 34 works progressively along the table and cuts pattern pieces until the carriages 36 and 38 reach the phantom position illustrated in FIG. 1 adjacent the loading end of the table. In preparation for a material moving or indexing operation, a rotary encoder 62 mounted on the X-carriage 36 is energized to measure any relative movement between the X-carriage and the conveyor belt 16. To this end, the encoder has a pinion 64 engaged with a segmented gear rack 66 mounted on the conveyor belt 16. As the X-carriage 36 is moved from the phantom position in FIG. 1 back to the solid-line position, the output signal of the encoder 62 is applied to the conveyor drive motor 60 to energize the motor and cause the conveyor to be slaved to and move jointly with the X-carriage 36. In this manner, the position of the sheet material on the conveyor can be precisely coordinated with the position of the X-carriage in the cutting program. If there is any discrepancy between the X-carriage position and the indexed position of the layup after a new segment has been moved onto the conveyor table, an error detection circuit may be used to readjust the X-carriage in the X-coordinate direction. For a more complete description of the indexing or "bite-feeding" operation, reference may be had to copending application Ser. No.

207,873, filed Nov. 18, 1980 by the assignee of the present application.

Figure 3:
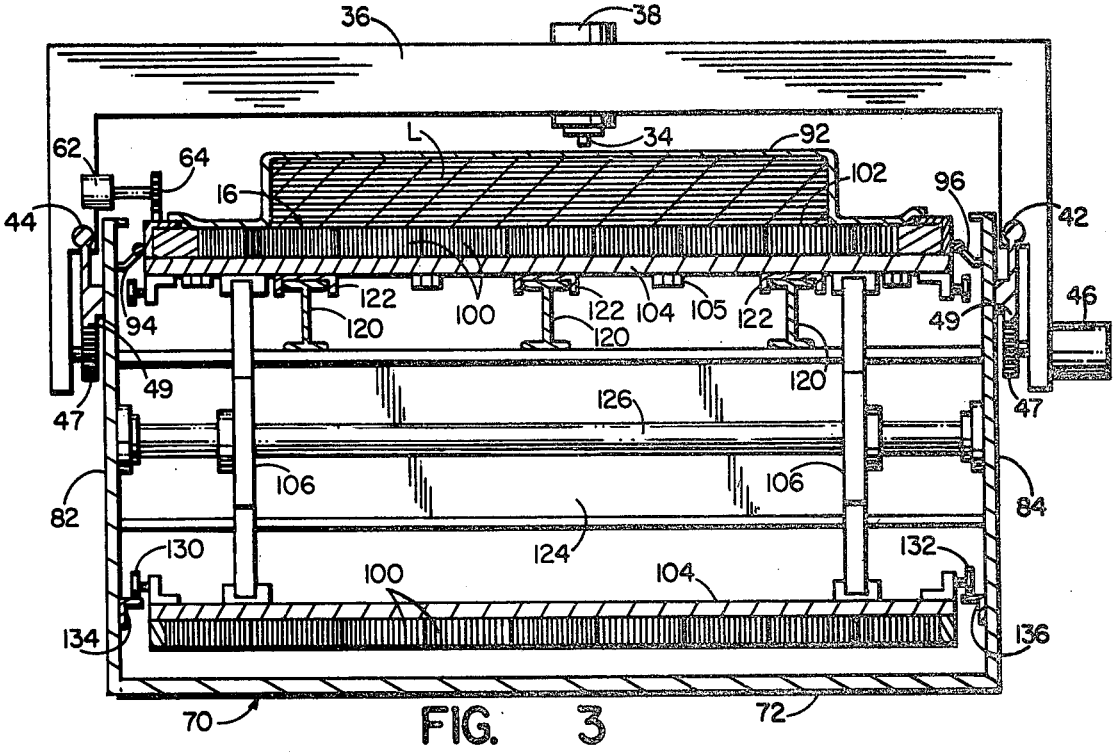
FIG. 3 is an enlarged sectional view of the cutting machine as seen along the sectioning line 3—3 of FIG. 2.

The conveyor belt 16 of the table 14 is mounted within an air-tight enclosure 70 that envelops the conveyor belt except for the portion of the belt defining the support surface on which the layup of sheet material is held. The enclosure 70 as seen in FIG. 2 includes a bottom wall 72, two end walls 74, 76 and two aprons 78 and 80 that bridge the opening between the end walls 74, 76 and the opposite longitudinal ends of the conveyor belt 16, respectively. Additionally, as shown in FIG. 3, the enclosure includes two lateral side walls 82, 84 which are connected with the bottom wall 72, the two end walls 74, 76 and aprons 78, 80 at the opposite ends of the table. The walls are air-impermeable and are welded or otherwise joined together in sealing relationship so that they form an air-tight, tank-like vessel in which the conveyor is positioned. All connections into the enclosure 70 from the exterior side of the table are sealed and thus, air can only enter the enclosure through the opening at the top that is substantially occupied by the support surface of the conveyor.

A vacuum pump 90 is connected to the bottom wall 72 so that the enclosure 70 effectively forms a vacuum chamber when limp sheet material is positioned on the conveyor belt and an air seal is established over the sheet material and the portion of the enclosure opening around the material. Such a seal is formed by means of an air-impermeable overlay material 92 shown in FIG. 3 on top of the layup and a set of sliding seals 94, 96 along the upper run of the conveyor belt 16 at each lateral side respectively. The overlay material 92 is spread on top of the layup after the layup has been formed on the spreading table 12.

Figure 5:
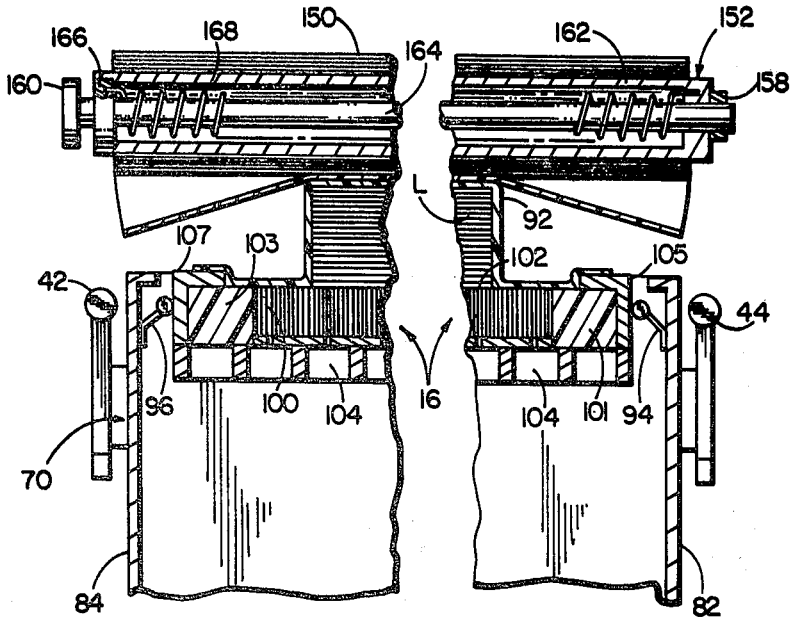
FIG. 5 is an enlarged cross sectional view of the cutting table as viewed along the sectioning line 5—5 in FIG. 4. with the central portion broken away.
Figure 6:
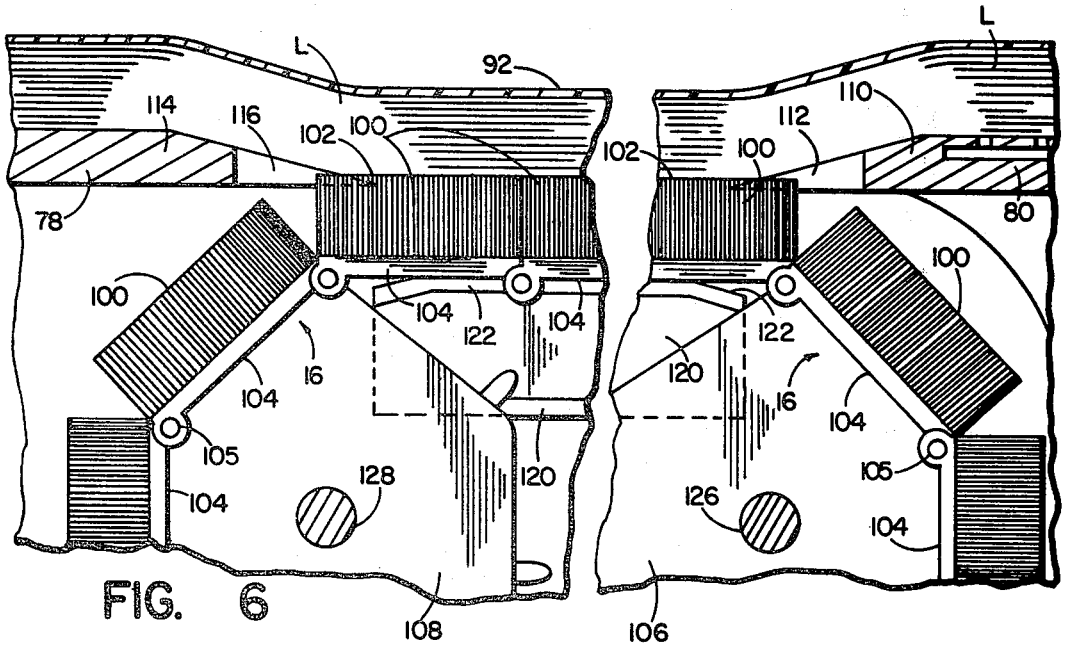
FIG. 6 is an enlarged fragmentary elevation view showing the opposite ends of the conveyor in the cutting machine.

As shown in FIGS. 3, 5 and 6, the conveyor belt 16 in one embodiment is air-permeable and comprised by perforated blocks 100 of bristles with the bases being perforated and the bristles have free ends projecting outwardly of the conveyor and defining the support surface 102 on which the layup L of limp sheet material is held. Rows of the blocks 100 are held on perforate grid sections 104 as shown most clearly in FIG. 5 so that air-evacutated from the layup L is drawn downwardly into the chamber formed by the enclosure 70 and, at the same time, the limp sheet material is compressed on the support surface 102. For further description of the grid sections and the bristle blocks, reference may be had to copending application Ser. No. 207,873, referenced above.

Along the lateral edges of the conveyor belt 16, the bristle blocks 100 are bounded by air-impermeable barrier blocks 101, 103 and sealing bars 105, 107 respectively. The sliding seals 94, 96 rest on the bars 105, 107 respectively and maintain a seal to close the enclosure 70 during cutting and during the interval when the layup of sheet material is being moved by the conveyor. The air-impermeable overlay 92, together with the blocks and side bars, completely seal the opening along each lateral edge of the layup between the layup and the lateral side walls 82, 84.

As shown in FIG. 6, each of the grid sections 104, together with the associated bristle blocks, are interconnected by hinges 105 to form the segmented conveyor belt 16. Star wheels or sprockets 106 engage the individual sections at the loading end of the conveyor, and a similar set of star wheels 108 drivingly engage the sections at the opposite end. In FIG. 2, the star wheels 108 are driven by the conveyor drive motor 60 to advance the conveyor belt 16 and pull the layup of sheet material onto the conveyor table 14 from the spreading table 12 and move the cut portion of the layup off of the conveyor table at the opposite end onto the discharge table 18.

Figure 7:
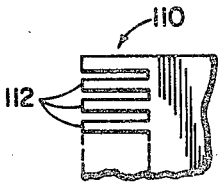
FIG. 7 is a fragmentary top plan view of a transfer comb at one end of the conveyor shown in FIG. 6.

At the loading end of the conveyor table 14, the apron 80 includes a transfer comb 110 shown in FIGS. 6 and 7 with a plurality of sloped teeth 112 projecting into the bristles of the blocks 100. The teeth 112 slope from the apron downwardly to a plane slightly below the level of the support surface 102 defined by the bristle blocks so that the multi-ply layup of sheet material can flow smoothly over the air bearing formed on the apron 80 onto the support surface of the conveyor without distorting or severely stretching the material in the loading process.

Similarly, the apron 78 at the unloading end of the conveyor table includes a similar comb 114 with sloped teeth 116 to lift the layup off of the support surface 102 and guide the layup smoothly over the apron 78 without distortion or stretching of the cut material. The teeth 116 slope upwardly from a plane slightly below the support surface 102 to ensure that the cut pattern pieces are lifted off of the surface as the grid sections 104 and the bristle blocks 100 revolve from the upper to the lower runs of the conveyor.

It should be apparent that the layup of sheet material and the air impermeable overlay 92 seal the opening in the enclosure 70 in the apron regions at opposite longitudinal ends of the conveyor table 14. The overlay 92 and the sliding seals 94, 96 seal the opening along the lateral sides of the layup and the conveyor belt as stated above. Consequently, a substantially complete seal over the opening prevents leakage of air from above the layup into the vacuum chamber formed within the enclosure and reduces the work load on the vacuum pump 90 while at the same time maintaining a desired pressure differential across the layup for compressing the sheet material and holding the material in place for cutting.

Since the downward forces produced by the weight of the layup L and atmospheric pressure operating on the overlay material 92 and the layup are substantial when vacuum within the enclosure is only a few inches of water below atmospheric pressure, a substantial load must be supported by the upper run of the conveyor belt 16. For this reason, a plurality of beams 120 extend longitudinally under the upper run of the conveyor. As shown in FIG. 6, the beams 120 extend substantially between the axles 126 and 128 for the star wheels 106, 108 respectively, and include a slight bevel at each end in order to smoothly transfer the loads on each grid section 104 between the star wheels and the beams 120. The upper surface of the beams 120 is coated or covered with a low friction bearing material, such as a Teflon plate 122, and the hinged grid sections in the upper run of the conveyor rest on the plates and are supported by the beams 120. The low friction material insures that the grid sections slide smoothly along the beams as the conveyor 16 is driven. The beams 120 are in turn supported by transverse beams 124 that extend under the longitudinal beams 120 and which are fastened to the opposite lateral walls 82, 84 of the enclosure 70.

The lower run of the conveyor 16 is supported within the enclosure 70 by means of sets of rollers 130,132 between each section of the conveyor as shown most clearly in FIG. 3, and rails 134, 136 on the inner side of the lateral side walls 82, 84. The rails 134, 136 are substantially co-extensive with the beams 120.

During movement of the layup by the conveyor, it is desirable to reduce the level of vacuum which secures the sheet material to the conveyor. Such a reduction decreases the load of the upper run of the conveyor on the support beams 122, 124 and also reduces the friction between the plates 122 and the grid sections 104 of the conveyor. Such a reduction can be accomplished by a bleed valve 135 in FIG. 2 or by reducing the speed of the vacuum pump 90. Generally a short segment of the layup L adjacent the loading end of the conveyor table 14 is not cut. There is little leakage through the uncut section and a more secure attachment is created between the layup and the conveyor at the loading end of the conveyor table 14 for pulling the next segment of the layup from the spreading table 12 onto the conveyor table.

FIG. 2 illustrates one design of the conveyor table 14 which permits a reduction in the vacuum and friction forces along most of the length of the support beams 120 without loss of attachment forces at the loading end of the table 14. A set of vertical baffle plates 137, 138 are installed in the tank-like enclosure 70 intermediate the bleed valve 135 and the connection of the vacuum pump 90 into the one portion of the enclosure 70 on the side of the baffle plates adjacent the loading end of the table.

During a cutting operation, the bleed valve 135 is closed and pressure or vacuum throughout the entire enclosure 70 and at the support surface of the conveyor 16 is the same. When the layup L of sheet material is to be moved by the conveyor, the bleed valve adjacent the discharging end of the table 14 is opened and a dynamic flow of air is established through the enclosure from one end to the other. The baffle plates 137, 138 extend in close fitting relationship with the upper and lower runs of the conveyor but provide a clearance which permits conveyor movement and allows limited leakage of air. The clearance behaves as an orifice to the dynamic flow and produces a pressure drop from one side of the baffles to the other. As a result, the friction and material holddown forces adjacent the discharge end of the conveyor are reduced, but the same forces at the loading end are preserved to secure the uncut segment of the layup to the conveyor for loading on the table 14.

One major advantage of the conveyor table 14 over the prior art table is the absence of a vacuum zoning system that applies the vacuum to limited portions of the support surface on which the layup of sheet material is held during cutting. With the present invention, the complex structure forming a plurality of vacuum chambers under the upper run of the conveyor, the valving mechanism for actuating each of the chambers and the mechanism actuating the valves in accordance with movement of the cutting blade 34 along the layup are all eliminated. The disclosed conveyor table is, accordingly, simpler in construction and much less expensive to manufacture and maintain. Additionally, the load on the vacuum pump with the enclosure 70 and without zoning the support surface of the table is less provided that appropriate means are employed to limit leakage through the cut material. This result is obtained for several reasons. In the prior art conveyor tables, the bristle blocks permitted air to flow not only vertically through the conveyor into the vacuum chambers, but also horizontally from the ends of the conveyor which were not sealed by end walls, such as the walls 74, 76 and aprons 78, 80. Although sacrificial barriers were commonly installed transversely in the bristles, after several cutting operations the barriers were destroyed and frequently were not replaced as required to maintain a cutting bed that inhibited horizontal flow from the ends of the conveyor.

Furthermore, the conveyor table 14 has no valves, ducting and chamber seals under the conveyor as additional sources of leakage into the vacuum system. In the zoned conveyor table of the prior art, the various leakage sources required a much larger vacuum generator. To maintain a vacuum of 5" of water at the support surface of the bristle blocks, it was necessary to draw a 10" vacuum at the pump connected through the ducts and valves to the bristles. With the conveyor table 14, a 6" vacuum at the pump produces substantially a 6" vacuum at the bristle support surface when an appropriate overlay covers the cut material. A substantial reduction in the power requirements of the vacuum system is achieved.

Figure 4:
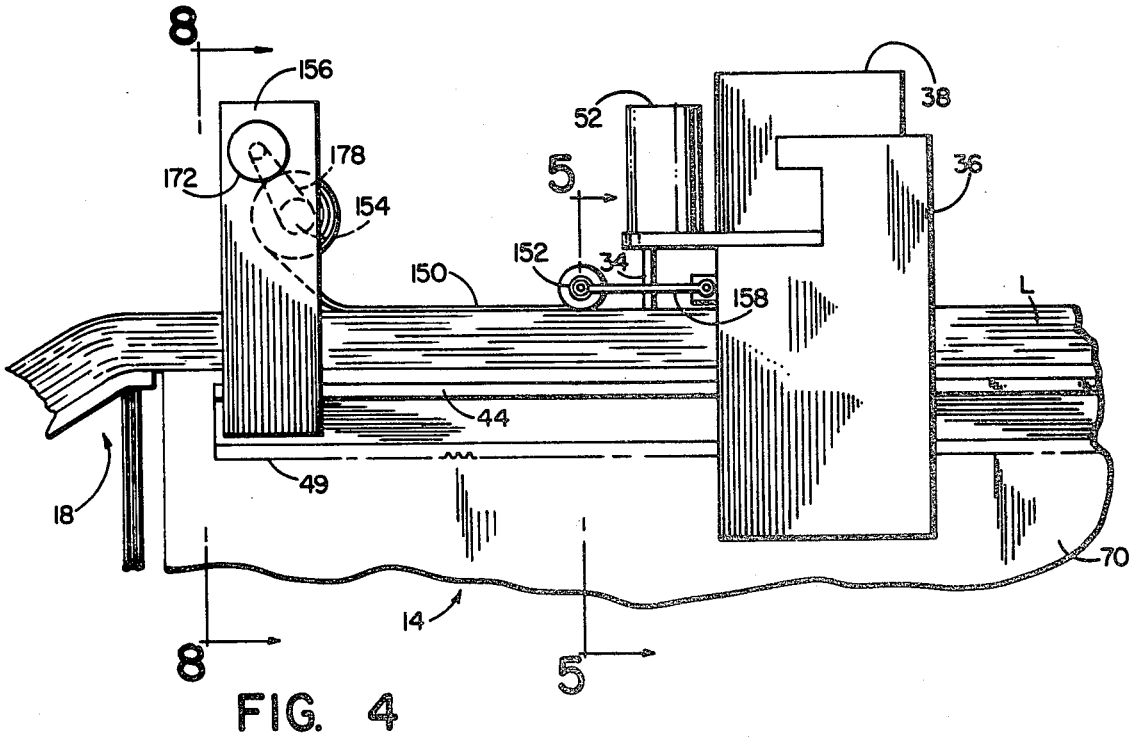
FIG. 4 is an enlarged fragmentary side elevation view of the cutting machine in FIG. 2 and shows the strip of overlay material and the manner of spreading and retrieving the material on a layup.

To seal the limp sheet material and the overlay 92 after they have been cut by the blade 34, an elongated strip 150 of an air-impermeable overlay material, such as a 3 mil Mylar, is provided as shown in FIGS. 2 and 4 between a self-retracting roller 152 connected with the X-carriage 36 and a power driven roller 154 mounted on a stationary bridge 156 at the discharging end of the conveyor table 14. The overlay is wound onto the roller 152 in a counter-clockwise direction as illustrated in FIG. 4 and onto the roller 154 in the opposite, clockwise direction. The roller 152 is connected by a pair of pivotal links 158, 160 to the X-carriage 36 for movement back and forth over the layup L and spreading of the overlay on the layup. The roller and that portion of the overlay on the roller rest under their own weight on top of the layup L, and vacuum drawn through kerfs cut in the layup draws the unrolled or spread segment of the overlay firmly against the top of the layup.

The structure of the roller 152 is shown in detail in FIG. 5. The roller has an exterior sleeve 162 mounted for rotation on a central, non-rotatable axle 164. One or both ends of the axles are restrained against rotation by the connecting links 158, 160. A collar 166 is secured in non-rotating relationship to the axle 164 adjacent the link 160, and the exterior sleeve 162 is mounted for rotation on the collar. A resilient coil spring 168 is mounted coaxially over the axle 164 and is connected at one end to the non-rotating collar 166 and at the opposite end to the flange of the rotatable sleeve 162. As mounted, the coil spring 168 is tensioned as the overlay 150 is unwound from the roller 152, and provides the retracting torque for retrieving the overlay onto the roller when the carriage 36 moves back toward the discharging end of the conveyor table or when the overlay is otherwise free to do so.

Figure 8:
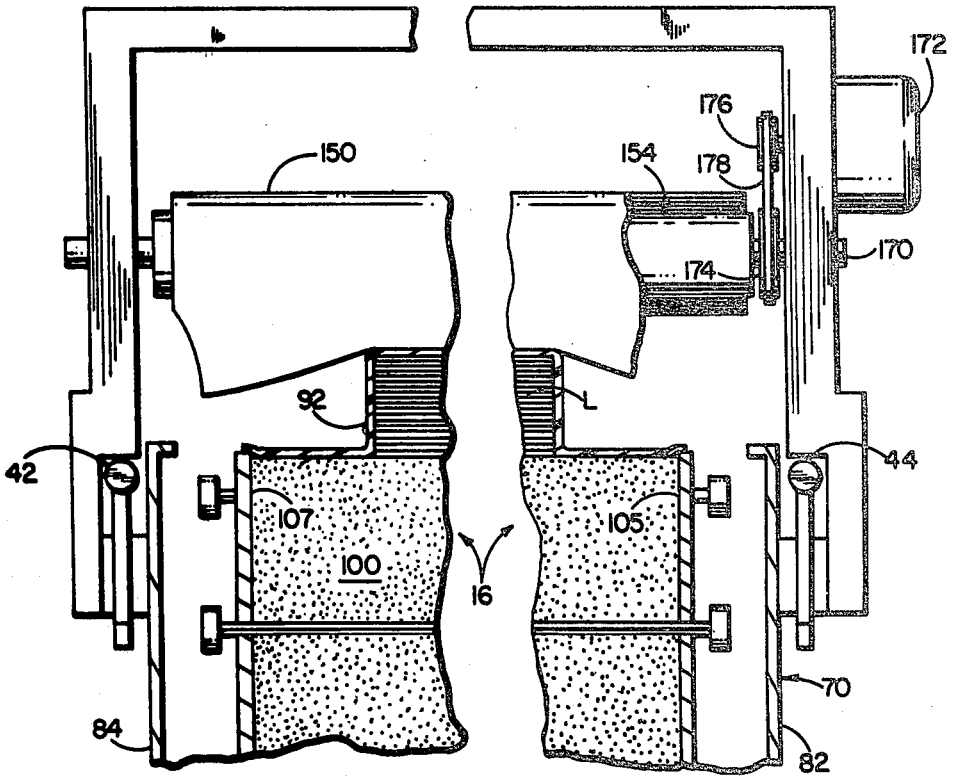
FIG. 8 is another enlarged cross sectional view of the cutting table as viewed along the sectioning line 8—8 in FIG. 4 with the central portion broken away.

The details of the power driven roller 154 and the associated drive mechanism are shown in detail in FIG. 8. The roller 154 is fixedly secured to a rotatable drive axle 170 in the stationary bridge 156 and is coupled in driving relationship with a retracting drive motor 172 through a system of pulleys 174, 176 and a drive belt 178. Whenever the drive motor 172 is energized, the roller 154 is driven in a direction which retracts the overlay 150 onto the roller. The drive belt 178 is preferably a large O-ring and allows a certain amount of slippage to exist between the rotations of the two pulleys 174 and 176 so that the motor 172 can be energized at a speed sufficient to ensure that the overlay 150 remains in tension as it is wound onto the roller.

A cutting operation is initiated in the layup L at the discharging end of the conveyor table 14 adjacent the bridge 156. Initially, the strip of material forming the overlay 150 is wound on the roller 152 connected to the X-carriage 36. The cutting blade 34 cuts the pattern pieces in the layup and works progressively from the discharging end of the table toward the opposite loading end. Hence, the distance between the X-carriage 36 and the bridge 156 generally increases during the cutting operation and the overlay material is spread on top of the layup to seal the cut material and prevent leakage into the evacuated enclosure 70.

The only leakage that exists during the cutting operation occurs in the narrow band of cut sheet material adjacent the cutting blade. The leakage in this area, however, is relatively small and does not deleteriously effect the forces which are compressing and holding the sheet material in the vicinity of the cutting blade.

As the X-carriage 36 moves along the conveyor table 14, the segment of the overlay 150 between the rollers 152 and 154 is held tightly against the upper surface of the layup L, and friction forces between the overlay and the layup ensure that the overlay material is drawn only from the roller 152 as needed. At the same time, torque in the retraction spring 168 progressively increases as more of the overlay material is pulled from the roller and spread on the layup. As the pattern pieces are circumnavigated, the X-carriage 36 does move back and forth. During backward movement the retracting spring 168 has sufficient torque to lift the overlay away from the layup and winds the overlay onto the roller 152 in opposition to any vacuum holding forces.

When cutting on a particular segment of the layup is complete, relative movement between the X-carriage 36 and the layup ceases and no additional overlay material is drawn from the roller 152. The conveyor 16 is then energized to shift the cut material in the layup off of the discharging end of the table and to draw uncut sheet material onto the table. As described above, the encoder 62 interconnects the X-carriage 36 with the conveyor to insure that there is joint movement between the layup of sheet material and the X-carriage during the material-moving mode.

As the cut sheet material is moved off of the conveyor table 14, the drive motor 172 is energized to drive the roller 154 in a clockwise direction and thereby retrieve the overlay 150 from the layup. As the roller 152 approaches the roller 154, the friction force of the overlay against the layup L is overcome by the retracting torque developed in the spring 168 of the roller 152 and the intermediate segment of the overlay is pulled free of the layup L and onto the roller 152. At this point or shortly thereafter, joint movement of the layup and the X-carriage 36 terminates and the drive motor 172 is simultaneously deenergized. Upon deenergization, the retracting torque of the roller 152 draws the rest of the strip of overlay material from the roller 154 onto the roller 152 and the overlay spreading apparatus is returned to its initial condition in preparation for the next cutting operation.

Accordingly, during cutting the overlay 150 is drawn from the roller 152 and rewound onto the roller as the X-carriage 36 moves back and forth relative to the layup L. On the other hand, the overlay material is moved between the layup and the roller 154 whenever there is relative movement between the layup L and the bridge 156 or table 14. In the process described above, the movement of the X-carriage 36 relative to the layup L occurs at a time different from the movement of the layup relative to the bridge 156. However, it is possible to move the layup L continuously at a predetermined rate over the table 14 while the cutting operation is performed simultaneously. In each instance it is necessary to periodically shift the overlay material accumulated on the roller 154 back to the roller 152. It is desirable to lift the overlay 150 off the cut sheet material as a transfer to the roller 152 takes place to avoid sliding and disturbing the cut sheet material underlying the overlay.

Accordingly, a method and apparatus have been disclosed for cutting limp sheet material under vacuum and sealing the cuts in the material with an air-impermeable overlay. The overlay is mounted on two rollers that extend in parallel and aligned relationship so that the overlay can be spread from one of the rollers onto the material and retrieved by the other as the material is moved off of the cutting machine. The roller from which the material is spread is a self-retracting roller so that movements of the cutting blade back and forth pull the material on and off of the roller without any undesirable accumulation of the overlay on the material being cut. The roller on which the overlay is retrieved after a cutting operation is motor driven to ensure that the overlay is retrieved from the cut sheet material before discharge from the machine.

While the present invention has been described in a preferred embodiment, it should be understood that numerous combinations and substitutions can be had without departing from the spirit of the invention. For example, it should be understood that the roller 152 may also be power driven by a torque motor which will allow the overlay 150 to be pulled off of or wound back onto the roller as the X-carriage 36 moves back and forth in a cutting operation. The power driven roller 154 on the stationary bridge 156 may be driven directly from the conveyor 16 by a flexible drive cable instead of the retracting drive motor since the roller is driven at the same time as the conveyor. Accordingly, the present invention has been described in several embodiments by way of illustration rather than limitation.

I claim:

1. An automatically controlled cutting machine for cutting layups of limp sheet material comprising:

a cutting table defining a support surface on which a multi-ply layup of limp sheet material is spread for cutting;

a tool carriage movable back and forth over the cutting table and having a cutting tool movable with the carriage to perform cutting operations on the material;

vacuum generating means connectable with the layup of sheet material on the support surface for generating a vacuum within the layup and compressing the sheet material on the support surface;

a first roller rotatably mounted to the tool carriage for movement with the carriage and cutting tool relative to the cutting table and a layup of sheet material on the support surface;

a second roller rotatably mounted to the cutting table in parallel and generally aligned relationship with the first roller;

an elongated strip of air-impermeable overlay material having opposite ends wound on the first and second rollers respectively with a portion of the strip extending between the rollers for sealing cut sheet material in a layup on the support surface of the cutting table;

first retracting means connected with the first roller for winding the strip of air-impermeable overlay material onto the first roller; and second retracting means connected with the second roller for winding the strip of air-impermeable overlay material onto the second roller.

2. An automatically controlled cutting machine as defined in claim 1 wherein the cutting table is a conveyor table having a conveyor defining the support surface whereby the airimpermeable overlay material can be spread on or retrieved from the support surface and a layup thereon as the conveyor is moving.

3. An automatically controlled cutting machine as defined in claim 1 wherein the first retracting means connected with the first roller on the tool carriage comprises a retracting spring connected between the first roller and the tool carriage.

4. An automatically controlled cutting machine as defined in claim 1 or 3 wherein the second retracting means mounted to the cutting table comprises a motor connected in driving relationship with the second roller for roller rotation.

5. An automatically controlled cutting machine as defined in claim 1 wherein the first roller is mounted to the tool carriage for limited movement toward and away from the support surface of the table to permit the second roller and the overlay material wound thereon to rest on top of a layup of sheet material supported on the surface.

6. An automatically controlled cutting machine as defined in claim 1 wherein a set of pivotal links extend between the tool carriage and the opposite ends of the first roller.

7. An automatically controlled cutting machine for cutting limp sheet material as defined in claim 1 wherein the tool carriage is movable back and forth over the cutting table in one coordinate direction;

the cutting table comprises a conveyor defining the support surface and located to convey the limp sheet material on the surface in the one coordinate direction; and the first and second rollers have axes of rotation extending generally parallel to the support surface and transverse to the one coordinate direction.

8. An automatically controlled cutting machine as defined in claim 7 further including controlled means for interconnecting the tool carriage and the conveyor for joint movement of the carriage and a layup in the one coordinate direction.

9. A method of cutting limp sheet material under vacuum with a cutting machine having a cutting table defining a work surface for holding the material during cutting comprising:

moving the limp sheet material on and off of a cutting table by means of a conveyor defining the work surface supporting the material during cutting;

applying a vacuum to the limp sheet material to hold the material under vacuum on the work surface for cutting;

cutting the limp sheet material on the work surface of the table under vacuum with a cutting tool mounted on a tool carriage movable along the table to reach different cutting areas of the sheet material;

providing an elongated strip of an air-impermeable overlay material and winding the opposite longitudinal ends of the strip into two rolls with an interconnecting portion between the rolls;

connecting a first of the two rolls of overlay material to the tool carriage and the second of the two rolls to the cutting table with the interconnecting portion overlying the conveyor and limp sheet material thereon;

spreading the overlay material from the first roll onto the conveyor and the limp sheet material to cover and seal cut portions of the limp material as the tool carriage and cutting tool move relative to the conveyor and limp sheet material in a cutting operation; and retrieving the overlay material onto the second roll from the conveyor and limp sheet material to uncover the cut portions of the limp sheet material as the conveyor moves the limp sheet material off of the cutting table.

10. A method of cutting limp sheet material as defined in claim 9 further including the step of periodically shifting the overlay material accumulated on the second roll to the first roll.

11. A method of cutting limp sheet material as defined in claim 10 wherein the step of shifting is performed while the interconnecting portion of the overlay material is lifted off of the limp sheet material.

12. A method of cutting limp sheet material as defined in claim 9 wherein the steps of cutting and spreading are performed at times different from the steps of moving and retrieving.

13. A method of cutting limp sheet material as defined in claim 9 wherein the steps of cutting and spreading are performed at the same times as the steps of moving and retrieving.

14. A method of cutting limp sheet material as defined in claim 9 wherein the step of connecting a first of the two rolls to the tool carriage comprises placing the first roll on a self-retracting roller and mounting the roller on the tool carriage for spreading and retrieving the overlay material as the carriage moves back and forth over the limp sheet material.

15. A method of cutting limp sheet material as defined in claim 9 or 14 wherein the step of connecting the second of the two rolls to the cutting table comprises placing the second roll on a roller and mounting the roller on the cutting table in driving relationship with a motor for retrieving the overlay material.

16. A method of cutting limp sheet material as defined in claim 9 wherein the steps of spreading and retrieving the overlay material are performed without sliding the interconnecting portion of the overlay material over the limp sheet material.

* * * * *